US008292683B2

(12) United States Patent
Axtell

(10) Patent No.: US 8,292,683 B2
(45) Date of Patent: Oct. 23, 2012

(54) WADER FLOATATION DEVICE

(76) Inventor: Robert Axtell, Muscatine, IA (US)

( * ) Notice: Subject to any disclaimer, the term of this patent is extended or adjusted under 35 U.S.C. 154(b) by 0 days.

(21) Appl. No.: 12/869,842

(22) Filed: Aug. 27, 2010

(65) Prior Publication Data

US 2012/0052756 A1 Mar. 1, 2012

(51) Int. Cl.
*B63B 35/74* (2006.01)

(52) U.S. Cl. ..... 441/132; 114/351

(58) Field of Classification Search ..... 441/109, 441/132, 129–131, 35, 39, 43; 114/351
See application file for complete search history.

(56) References Cited

U.S. PATENT DOCUMENTS

| | | | | |
|---|---|---|---|---|
| 1,555,589 | A * | 9/1925 | La Farina | 441/132 |
| 2,894,270 | A | 7/1959 | Manthos | |
| 2,958,876 | A | 11/1960 | Garrett | |
| 3,067,441 | A | 12/1962 | Dysard et al. | |
| 3,182,340 | A * | 5/1965 | Gentile | 441/32 |
| 3,432,868 | A | 3/1969 | Lowery | |
| 3,543,315 | A * | 12/1970 | Hoffman | 441/74 |
| 3,955,230 | A | 5/1976 | Rogers et al. | |
| 4,926,781 | A | 5/1990 | Bauer | |
| 5,046,978 | A | 9/1991 | Howerton | |
| 5,171,178 | A | 12/1992 | Creek et al. | |
| 5,290,196 | A | 3/1994 | Steel | |
| 5,334,067 | A | 8/1994 | Henry et al. | |
| 5,385,497 | A * | 1/1995 | Chu | 441/129 |
| 5,421,283 | A * | 6/1995 | Bruggemann et al. | 114/357 |
| 5,540,179 | A | 7/1996 | Mayfield | |
| 5,597,277 | A | 1/1997 | Mayfield | |
| 6,168,489 | B1 | 1/2001 | Huston | |
| 6,273,774 | B1 | 8/2001 | Warzecha | |
| 6,491,558 | B1 | 12/2002 | Myers | |
| 6,843,695 | B1 | 1/2005 | Jackson et al. | |
| 7,314,399 | B2 | 1/2008 | Turner | |
| 2004/0038603 | A1 | 2/2004 | Gaspar | |
| 2005/0026520 | A1 | 2/2005 | Howerton | |
| 2005/0028719 | A1 * | 2/2005 | Everett | 114/362 |
| 2007/0141925 | A1 | 6/2007 | Turner | |
| 2007/0249246 | A1 | 10/2007 | Neidert et al. | |

* cited by examiner

*Primary Examiner* — Edwin Swinehart
(74) *Attorney, Agent, or Firm* — McKee, Voorhees & Sease, P.L.C.

(57) ABSTRACT

A buoyant wading aid has a generally U-shaped body. The body includes a front portion and rearwardly extending legs. A pair of handles are provided on the legs. A storage container may be tethered to the body of wading aid to be towed behind the body when in use. The storage container may be adjusted into a transport configuration between and supported by the legs. The handles may be rigidly attached to a frame that provides structural support for the body of the wading aid.

14 Claims, 6 Drawing Sheets

WADER FLOATATION DEVICE

FIELD OF THE INVENTION

This invention relates generally to buoyant devices for use by people wading or walking in water.

BACKGROUND OF THE INVENTION

When hunting or fishing it is often desirable for a person to wade out into a body of water. This can be useful for getting into an optimum position for fishing, deploying hunting decoys, or to watch for water fowl or other game being hunted. Commonly the bottom of such a body of water will be muddy and uneven. Furthermore, it is not uncommon for the water to be cloudy such that it is difficult to see the contours of the bottom. As a result, it can be difficult to walk or wade through such water without slipping or getting stuck in the mud. At best, this makes it slow and difficult to get around. It can also result in a hunter or person fishing slipping and getting wet. Worst of all, it can be dangerous, particularly if the person is alone.

It can also be difficult or inconvenient for such a person to carry desired equipment with them, such as fire arms, fishing poles, decoys, food and beverages, or other desired items.

SUMMARY OF THE INVENTION

It is an object of the present invention to provide a buoyant device to aid in wading in water.

It is another object of the present invention to provide a buoyant wading aid that includes a pair of handles that can be grasped by a user while wading in water.

It is a further object of the present invention to provide a buoyant wading device that includes a generally U-shaped opening within which a user can stand and grasp handles provided on the device while wading in water.

According to one embodiment of the present invention is directed to a buoyant wading aid that has a body including a closed front portion and a pair of rearwardly extending legs. The front portion and the legs share an internal surface that forms a U-shaped perimeter that defines a walking space between the two legs. A pair of handles extends upwardly from a top surface of the legs. The body may comprise a rigid frame surrounded by a buoyant material. The handles may be rigidly attached to the frame and extend from the frame upwardly above a top surface of the buoyant material. An accessory holder may be rigidly affixed to the frame and extend above a top surface of the front portion of the body. Attachment structures may be rigidly attached to the frame and extend rearwardly from the legs to permit attachment of a floating container behind the body. The wading aid may further include a detachable floating container that fits between the legs and is supported by the top surface of the legs in a transport configuration, and which may be attached to the attachment structures to float behind the body when in use.

DETAILED DESCRIPTION OF THE PREFERRED EMBODIMENTS

Figure 1:
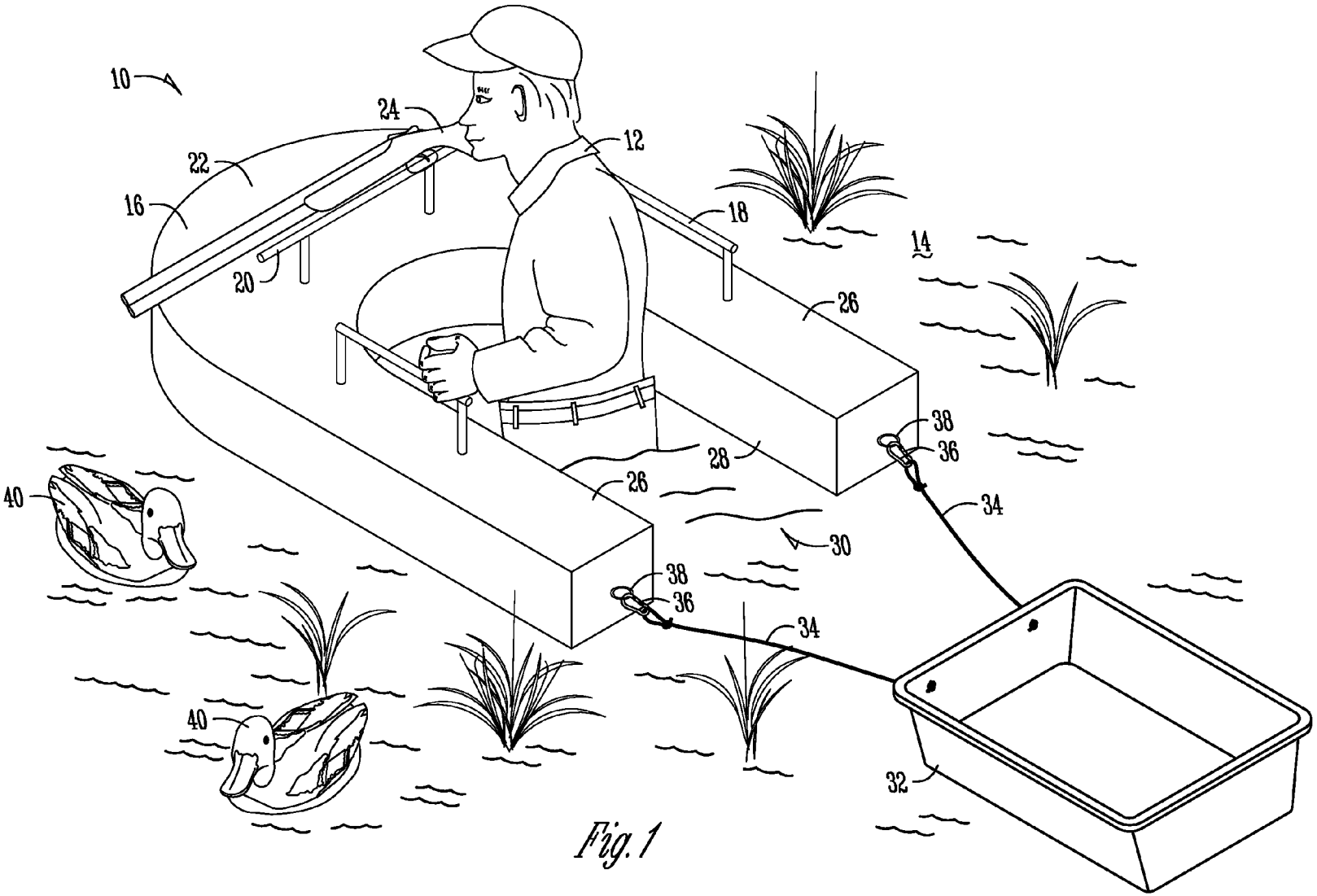
FIG. 1 is a perspective view of a buoyant wading aid according one embodiment of the present invention showing the wading aid in use with a user wading in water with a floating storage container being towed behind.

FIG. 1 shows a wading aid 10 according to one embodiment of the present invention in use by a hunter 12 wading in a body of water 14. As can be seen in FIG. 1, the wading aid 10 has a buoyant body 16 that includes a pair of upwardly extending handles 18. The handles 18 permit a user to grasp onto the wading aid 10 in order to be supported for steady walking across the muddy and uneven bottom of the body of water 14. A pair of legs 26 extends rearwardly from a front portion 22 of the body 16. The legs 26 and front portion 22 have a generally contiguous inner surface 28. The inner surface 28 defines a generally U-shaped open space 30 surrounded on three sides by the legs 26 and the front portion 22. The open space 30 acts as a walking space for the user 12.

An accessory rack 20 is provided at the front portion 22 of the body 16. The accessory rack 20 may be adapted to hold a variety of accessories. For example, the accessory rack 20 may be adapted to safely hold and support a firearm 24. The accessory rack 20 may be configured to hold a variety of different accessories.

A container 32 is tethered to the body 16. In the embodiment show, the container 32 is attached by flexible tethers 34 that include clips 36 that engage attachment structures 38. The attachment structures 38 in the embodiment shown are rings that extend rearwardly from the rear of the legs 26. The attachment structures could include any structure suitable for connecting with the tethers, for example, clips, hooks, Velcro hook and loop fasteners, and others. Preferably, the container 32 will be buoyant so that it can support and haul items behind the wading aid 10 as a user 12 walks through the water 14 to a desired location. For example, the container 32 may be used to carry decoys 40 to a desired location in the water 14.

Figure 2:
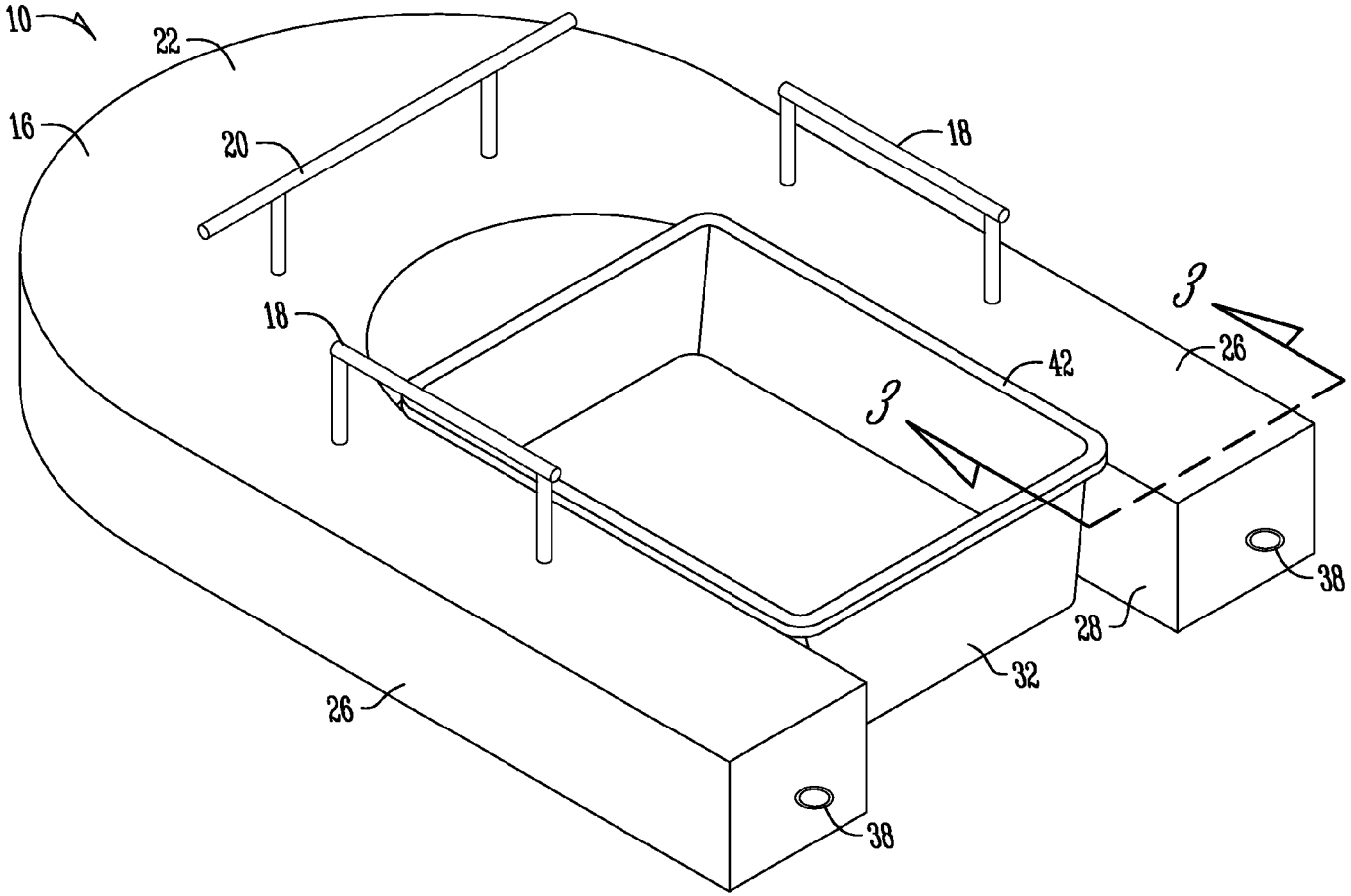
FIG. 2 is an isometric view of the buoyant wading aid of FIG. 1 removed from the water with the storage container in a transport configuration between the legs of body of the wading aid.

FIG. 2 shows the wading aid 10 of FIG. 1 with the storage container 32 placed in a transport configuration between the legs 26. In the embodiments shown, the container 32 includes a lip 42 around its upper perimeter that extends outwardly beyond the storage portion of the container 32. The lip 42 extends over the inside edges of the legs 26 such that lifting the body 16 with the container 32 in the storage configuration shown in FIG. 2 will also lift and support the container 32. This transport configuration permits the body 16 and storage container 32 to be stored and transported in a compact configuration. Additionally, including the lip 42 that is retained by the inside top edges of the legs 26 permits the combination of the body 16 and container 32 to be conveniently carried as a unit to and from the water.

Figure 3:
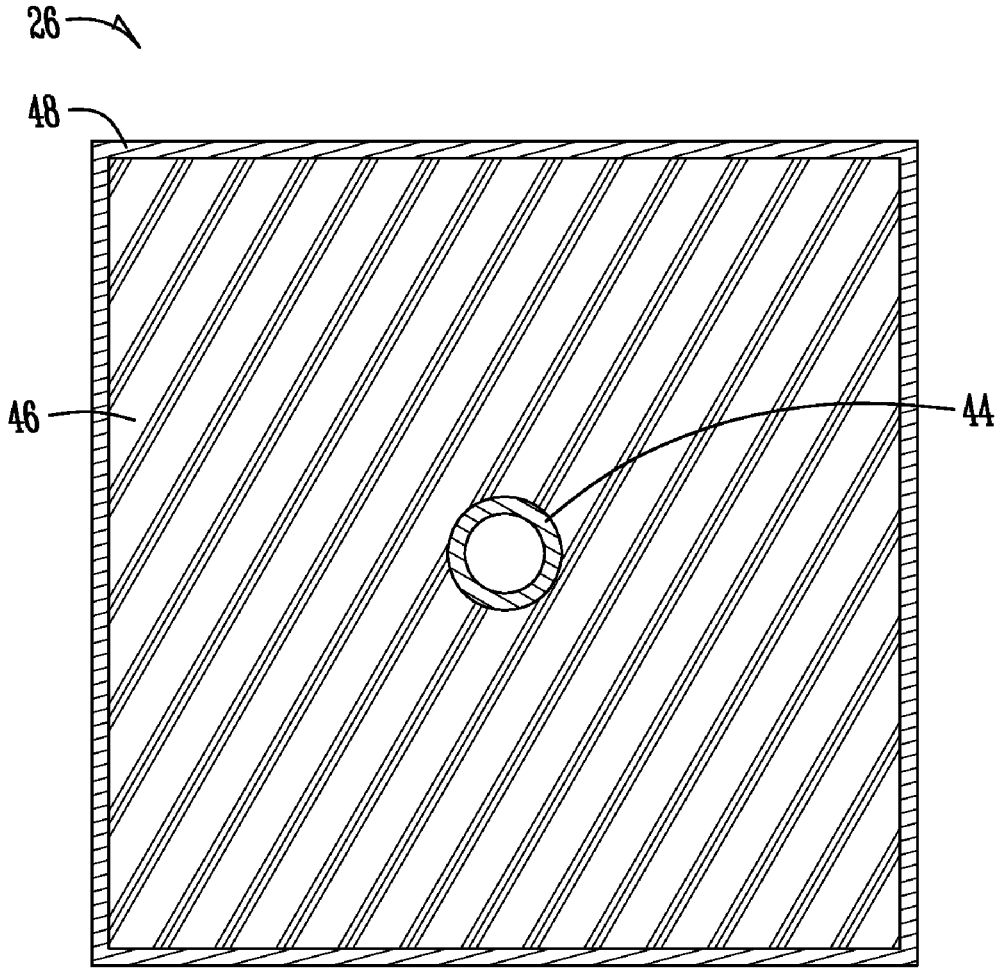
FIG. 3 is a cross-sectional view of one of the legs of the wading aid of FIG. 2.

A currently preferred construction for the body 16 utilizes a rigid frame surrounded by buoyant material having the desired shape of the body. The buoyant material may be surrounded by a protective coating. FIG. 3 shows a cross-sectional view of a leg 26 made from this construction. The inner frame 44 is formed from a rigid durable material to provide support for the body 16. In a preferred embodiment, the frame 44 is formed from steel welded tubes welded together. A closed-cell foam 46 may be used as the buoyant material and provides the bulk of the material for the body 16. According to one embodiment the closed-cell foam is made from a spray-applied polyurethane insulation sold under the brand name HEATLOK SOY. A covering 48, such as a rubberized coating, is applied to the exterior of the body 16. The coating 48 may be colorized or may include a desired pattern, such as a camouflage pattern.

Figure 4:
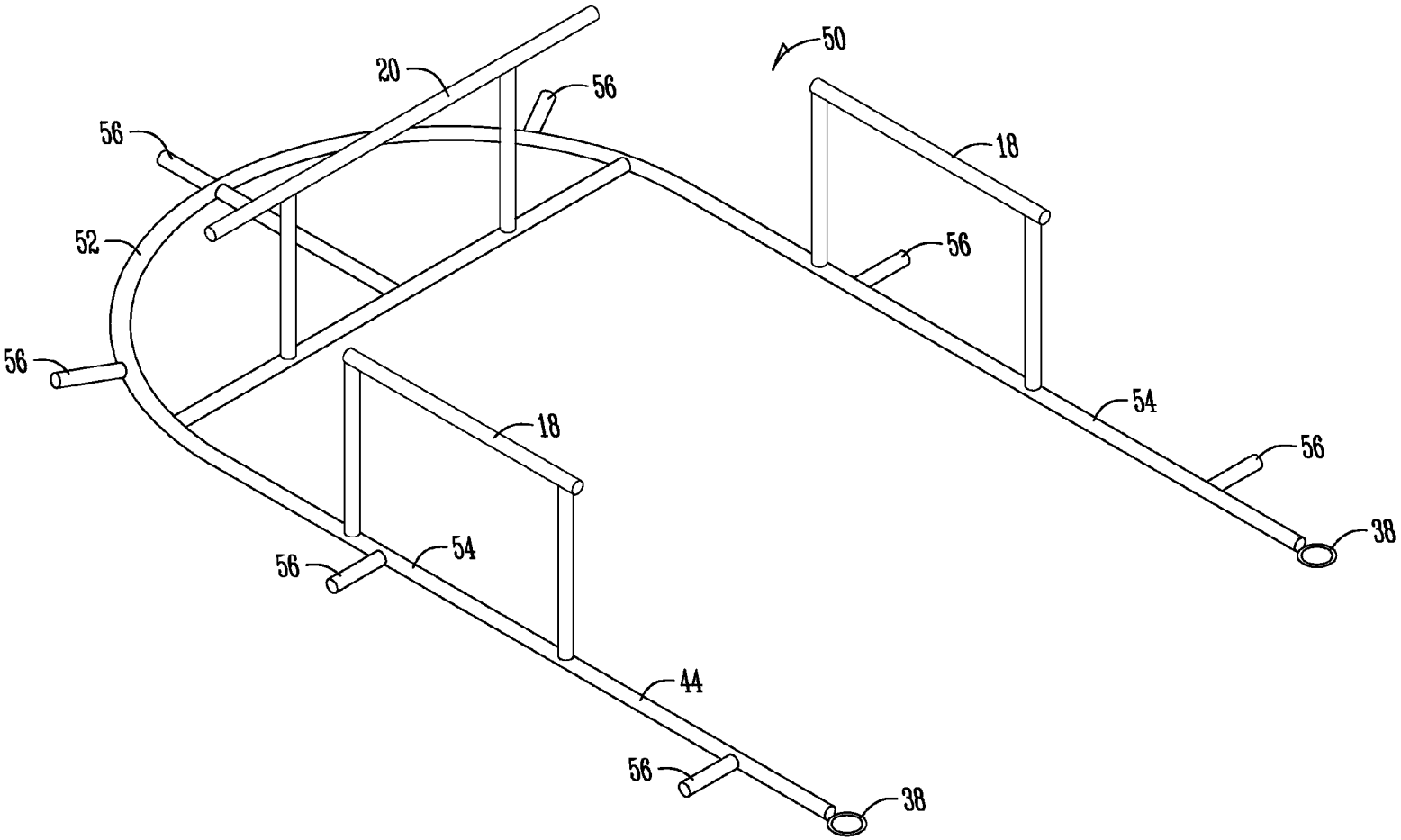
FIG. 4 is an isometric view of the internal frame of the wading aid of FIGS. 1 and 2.

FIG. 4 shows a frame 50 formed from a plurality of frame members 44. The frame 50 includes a front support structure 52 and a pair of elongated leg support frame members 54. Spacers 56 extend outwardly from the leg support frame members 54 and the front support structure 52. The spacers 56 are useful for aligning the frame 50 within a mold during construction, and also provides some additional structural support. The handle 18 and the accessory rack 20 are also rigidly attached as part of the frame 50. In one embodiment, all of the structures of the frame members 44, including the leg support frame members 54, the front support structure 52, the handle 18, the accessory rack 20, and the spacers 56 are formed from steel tubing that has been welded together in the desired formation. It may be acceptable to form the frame 50 from other suitable rigid materials such as PVC tubing, metal materials, wood, or other materials that would provide structural integrity to the buoyant material.

Figure 5:
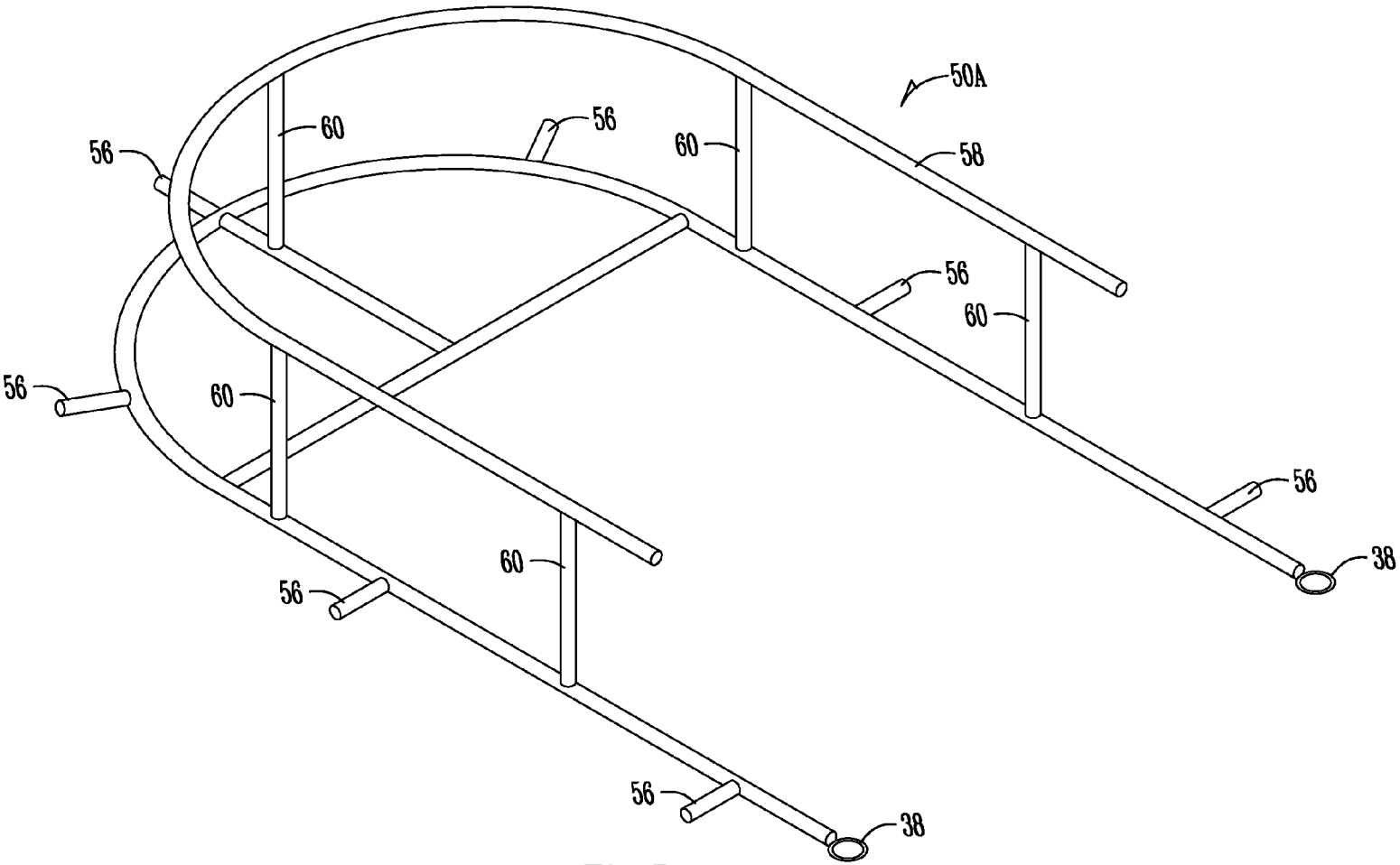
FIG. 5 is an isometric view of an alternative embodiment of a frame that includes a rounded rail at the front portion of the body.

FIG. 5 shows an alternative embodiment of a frame 50A. It is similar in construction to the frame 50 of FIG. 4 except that instead of having separate handles 18 and an accessory rack 20, a single rail 58 is supported above the lower frame work by risers 60. The rail 58, when the foam body is applied, will extend above the surface of the front portion and legs of the body. The rail 58 will provide handles all the way around the sides and front portion of the body to permit a user to hang onto while wading in water. Additionally, the rail 58 may provide an attachment point for accessories.

According to other embodiments, the body 16 may be formed from any suitable material. The material should be sufficiently lighter than water such that it will float and support a significant portion of a user's weight without being submerged when in water. Preferably, the material will be largely impervious to water. Acceptable materials may include plastics, wood, foam, or composite constructions. For example, the body 16 could be formed from molded plastic. Two hard plastic shells could be injection molded and then joined together along a seam to create a hollow plastic shell in the shape shown in FIG. 2. The handle 18, rings 38 and accessory rack 20 could be attached to the hard plastic shell. Reinforcement would need to be provided to the plastic shell at the point of attachment to avoid warping of failure of the plastic at those points. Additionally, water proofing would be needed at the attachment points.

Figure 6:
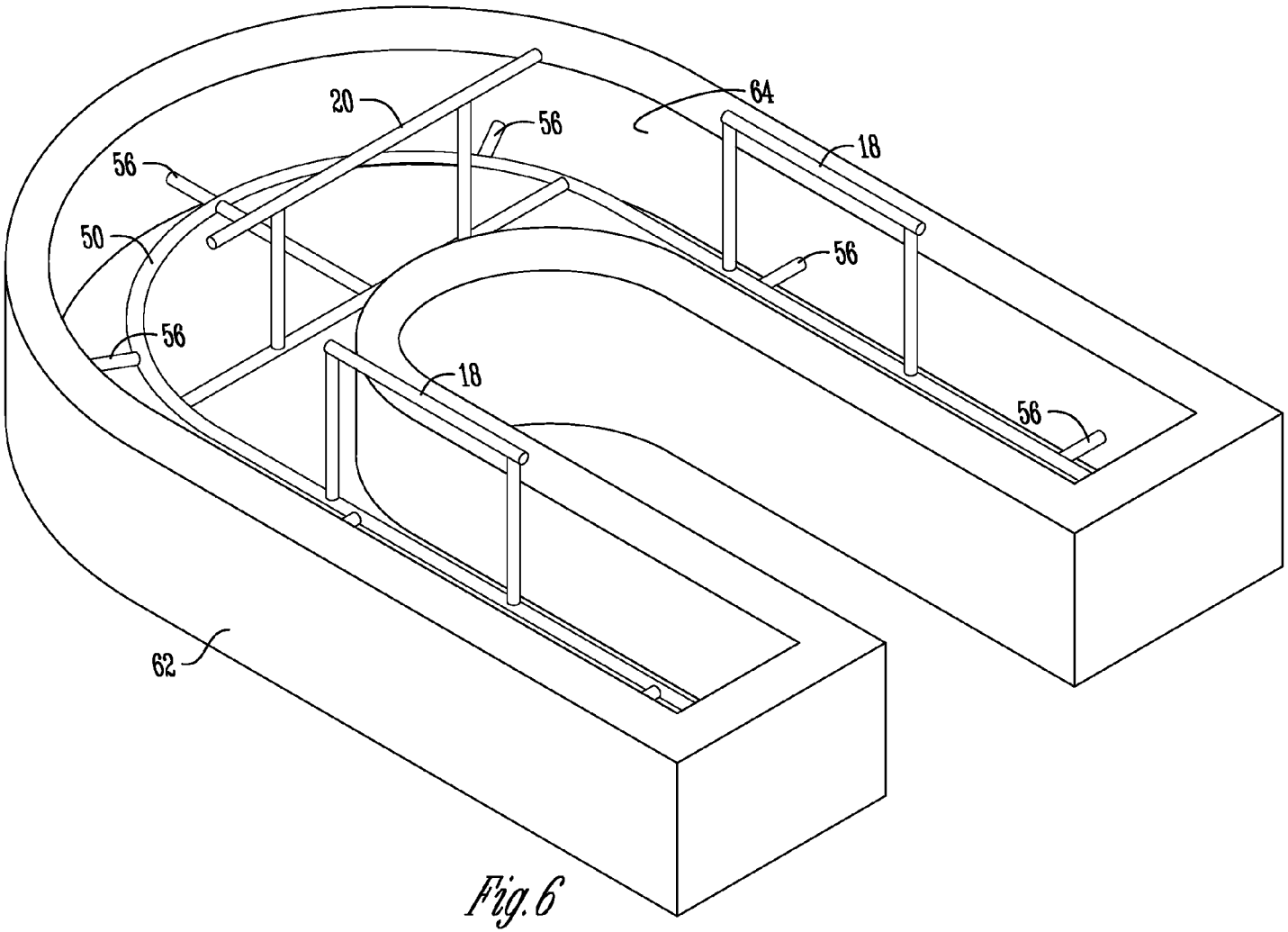
FIG. 6 shows the frame from FIG. 4 in a mold ready to have foam applied to form the body of the wading aid.

FIG. 6 shows a mold 62 used to form the body of a wading aid according to one embodiment of the present invention. The frame 50 is placed within the interior of the mold 62. The mold 62 includes an interior surface 64 which retains material that is poured, injected or sprayed around the frame 50. The spacers 56 are used to appropriately align the frame 50 within the mold 62. A buoyant material such as a closed-cell polyurethane foam is applied within the mold. According to a preferred embodiment this closed-cell polyurethane foam is created by spraying a two liquid components into the mold 62 and around the frame 50. According to one embodiment the two-component mixture includes a isocyanate component and a resin component that mix together and react by foaming and expanding to completely fill the mold and then is allowed to dry and cure into a hardened foam material. Preferably the two components will be applied at the recommended temperature of about 100-120 degrees Fahrenheit and the recommended pressure of about 800 psi to assure complete foaming. After the foam material has hardened and cured, at least partially, the body is removed from the mold 62. Those of ordinary skill in the art may be aware of other materials that could be used to create the buoyant material surrounding the frame 50. A rubberized coating (see FIG. 3) may be applied to the foam body by spraying, dipping, brushing, rolling, or other known mechanisms. The rubberized coating may include desired coloring, or include a camouflage pattern. The outer surface of the rubber coating may be painted or stained as desired. As a further alternative, instead of a rubberized coating, a paint or other sealant may be applied to the exterior of the foam body.

Accordingly, a novel wading aid 10 and a method of making and using the same has been described herein. Particular embodiments of the present invention have been disclosed in the drawings and above description. It should be understood that the invention is not limited to the particular embodiments shown and described, but extends to all equivalents within the scope of the following claims.

What is claimed is:

1. A buoyant wading aid to provide support to a user wading in water, the wading aid comprising:

a body that includes a front portion and a pair of legs extending rearwardly from the front portion;

an internal surface of the legs and front portion forms a generally U-shaped surface that defines a perimeter of a walking space between the two legs, the walking space being open without obstructions when approached from the rear;

a pair of hand rails extending upwardly from the legs, wherein the rails are spaced apart from each other at a distance that permits the rails to be simultaneously grasped by a user within the walking space while wading in water; and a firearm support extending upwardly from the front portion, the fire arm support adapted to retain and support a fire arm within reach of the user within the walking space while wading in water.

2. The wading aid of claim 1, wherein the buoyant material is closed-cell foam.

3. The wading aid of claim 1, wherein the body comprises a rigid frame surrounded by the buoyant material, and wherein the handles are fixedly attached to the frame and extend upwardly from the frame to above the buoyant material.

4. The wading aid of claim 3, wherein the rigid frame is formed from steel tubes welded together.

5. The wading aid of claim 3, wherein the frame comprises outwardly directed spacers for locating the frame in a mold.

6. The wading aid of claim 1, further comprising:

a storage container that fits between the legs of the of the body and is supported by a top surface of the legs when in a transport configuration; and a tether for connecting the storage container to attachment structures extending rearwardly from the legs.

7. A buoyant wading aid comprising:

a generally U-shaped body having a pair of spaced-apart legs, the space between the legs forming a walking space for a user, wherein the U-shaped body comprises a buoyant material;

a handle structure extending upwardly from the body within reach of a user in the walking space while wading in water, wherein the handle structure comprises a pair of handles extending upwardly from the spaced-apart legs above the buoyant material; and a storage container that fits between the legs of the body and is supported by an upper surface of the legs when in a transport configuration.

8. The wading aid of claim 7, wherein the buoyant material is a closed-cell foam.

9. The wading aid of claim 7, wherein the handle structure comprises a U-shaped rail.

10. The wading aid of claim 7, further comprising a rigid frame surrounded by the buoyant material, wherein the rigid frame is formed from steel tubes welded together.

11. The wading aid of claim 7, further comprising a rigid frame surrounded by the buoyant material, wherein the frame comprises outwardly directed spacers adapted for locating the frame in a mold.

12. The wading aid of claim 7, further comprising attachment structures attached to the legs and extending rearwardly from the legs.

13. The wading aid of claim 12, further comprising:

a tether for connecting the storage container to the attachment structures.

14. The wading aid of claim 7, further comprising a fire arm support extending upwardly from the U-shaped body, the fire arm support adapted to retain and support a fire arm within reach of the user within the walking space while wading in water.

* * * * *